US005441277A

United States Patent [19]

Lenhart et al.

[11] Patent Number: 5,441,277

[45] Date of Patent: Aug. 15, 1995

[54] METHOD OF PLAYING A BOARD GAME

[76] Inventors: Brad E. Lenhart; Jill R. Lenhart, both of 633 W. Addison St. #2N, Chicago, Ill. 60613

[21] Appl. No.: 275,294

[22] Filed: Jul. 14, 1994

[51] Int. Cl.[6] ..... A63F 3/00; A63F 9/18

[52] U.S. Cl. ..... 273/249; 273/272; 273/431; 273/432

[58] Field of Search ..... 273/272, 249, 429–432

[56] References Cited

U.S. PATENT DOCUMENTS 4,998,736 3/1991 Elrod ..... 273/249

5,248,148 9/1993 Toan ..... 273/249

*Primary Examiner*—Benjamin H. Layno

*Attorney, Agent, or Firm*—Marshall, O'Toole, Gerstein, Murray & Borun

[57] ABSTRACT

A game wherein, for a player to advance around a game board to a winning board position, the player must satisfactorily comply with instructions that solicit a rhyming response. The game board includes a starting space, a winning space, and a number of distinguishable spaces therebetween. The spaces are divided into several categories that are distinguishable by different indicia and/or different colors. Each category of space requires a player to comply with a particular instruction. When a player occupies one category of game board space, the player must recite a word that rhymes with a word selected at random; another category of game board space requires a player to create or recite a multi-line rhyme, one line ending with a word selected at random, e.g., and the remaining lines ending with a word that rhymes with the word selected at random—the last words of the remaining lines can be chosen by the player from any words, or instructions may require the player to use one or more last words from a list of rhyming words; another category of space on the game board requires a player to create or recite a multi-line greeting card message, wherein the last word of each line rhymes; another category of space on the game board requires a player to recite two multi-word lines from a literary or musical work, wherein one of the lines ends in a word that rhymes with an ending word of the other line.

30 Claims, 4 Drawing Sheets

FIG. 2A
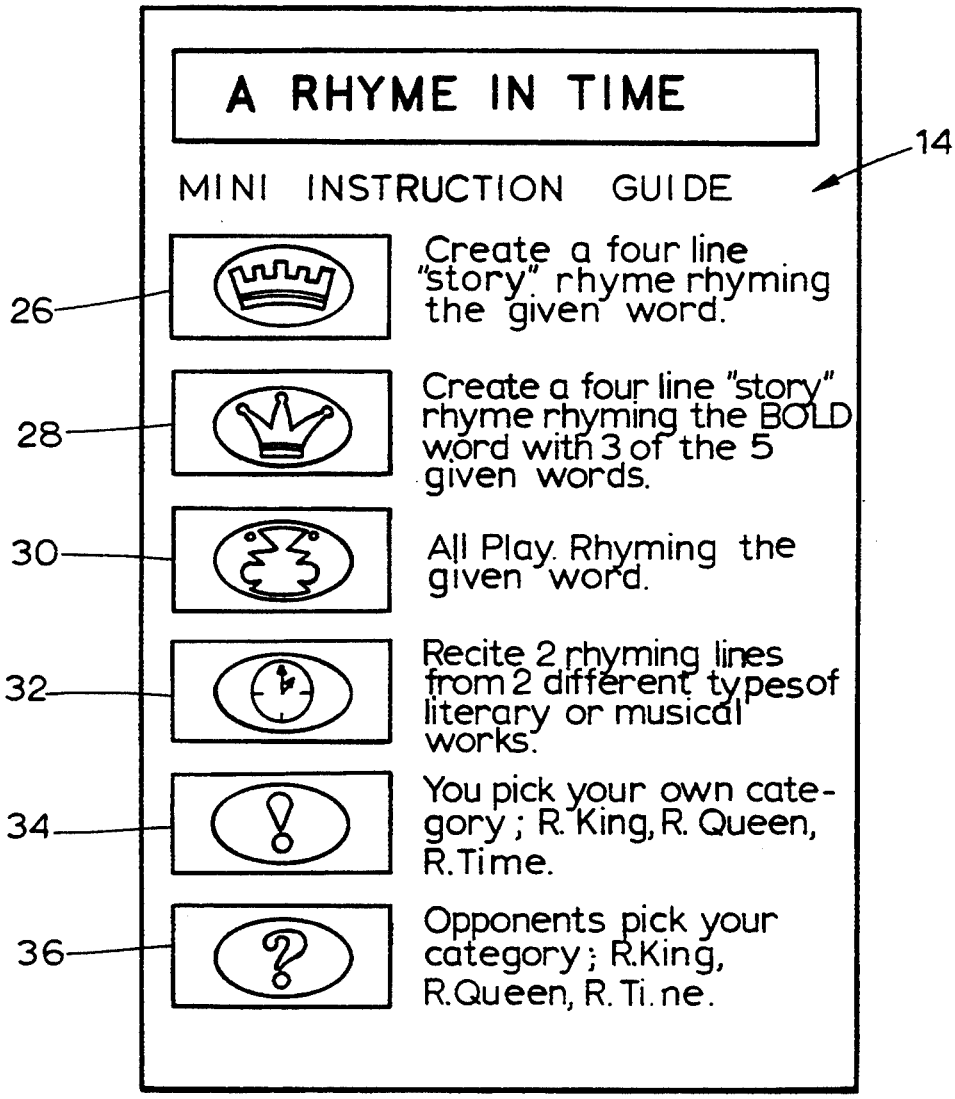
FIG. 4
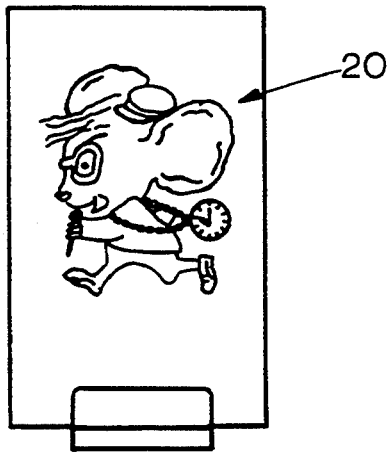
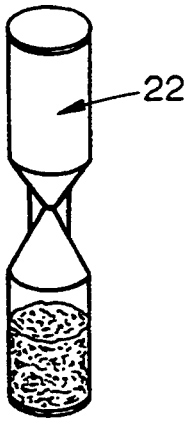
FIG. 6

FIG. 3A
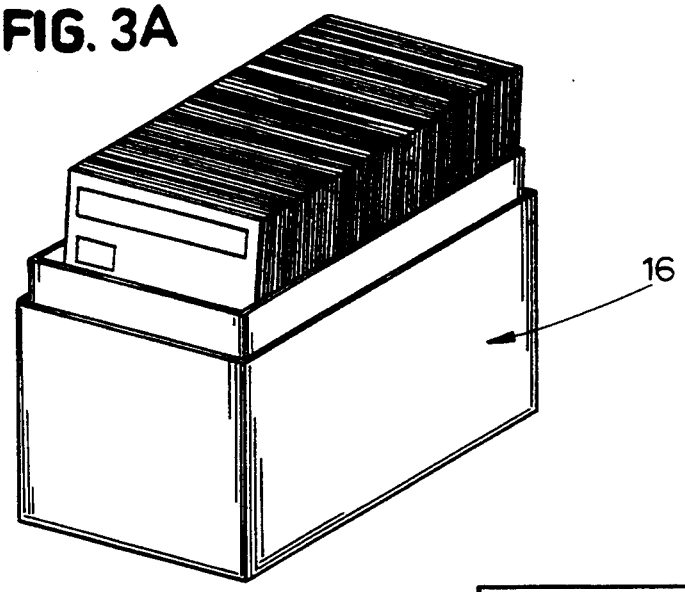
FIG.3B
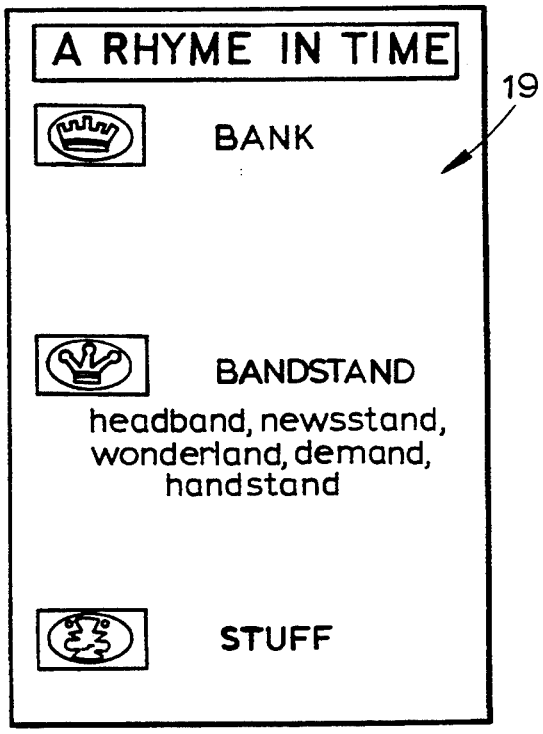
FIG.3C
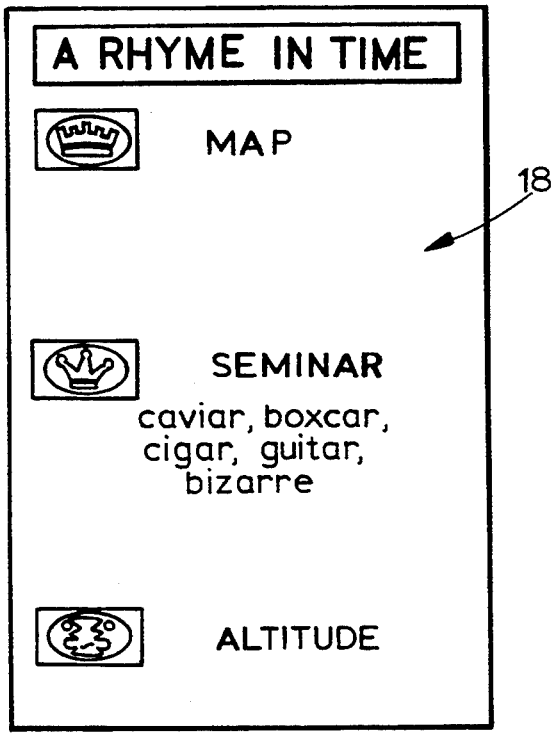
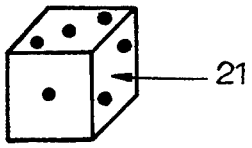
FIG. 5

METHOD OF PLAYING A BOARD GAME

FIELD OF THE INVENTION

The present invention is directed to a game apparatus and method that is interactive and challenging and capable of entertaining, testing a player's knowledge of musical and literary works, particularly poetry; testing a player's skill in recalling and reciting rhymes; creating a player's poetic skill and creativity; for testing a player's memory of rhyming lines from advertising jingles and the like; and to uncover a person's previously unrecognized, but innate poetic talents. More particularly, the present invention is directed to a board game apparatus and method wherein game instructions, such as appear on playing cards, require a player to recite or create a rhyming response in order to advance on a game board.

BACKGROUND OF THE INVENTION AND PRIOR ART

Many board games are known wherein a player's advancement around the board to a winning position depends to a great extent on a player's knowledge in a particular subject, such as trivia, math, vocabulary, and the like. Examples of such games include TRIVIAL PURSUIT®; a sentence game, as described in U.S. Pat. No. 4,671,516, that requires a player to form a sentence that includes a word selected at random; an educational game that tests a player's knowledge of fitness and nutrition, as described in U.S. Pat. No. 5,062,645; a Biblical question and answer board game, as described in U.S. Pat. No. 5,042,816; a board game that solicits a player's knowledge of entertainment performances, such as movies, as described in U.S. Pat. No. 5,121,928; math board games, as described in U.S. Pat. Nos. 4,561,658 and 4,717,154; and a thesaurus game, as described in U.S. Pat. No. 5,120,066.

U.S. Pat. No. 4,804,190 describes a pre-school-age children's game that introduces children to outer space and includes instruction cards, some of which include rhymes, but this game does not require a player to create or recite a rhyme for advancement on the game board. U.S. Pat. No. 4,871,176 mentions a "Mother Goose" VCR game, published by Western Publishing Company, but neither describes nor suggests a game apparatus or method that solicits rhyming responses from players.

While many such educational and knowledge-testing games are known, that are both recreational and educational, there has been a long-felt, unsolved need for some method of developing and enhancing a person's creativity, in terms of both creative thinking and creating writing that is not only entertaining, but also serves as a source of intellectual pleasure, as an educational supplementary tool in memory enhancing, in improving lyric writing skills and as an excellent tool in enhancing the creativity, and particularly the poetic skill, of one or more players. The game apparatus and method of the present invention solve this long-felt need.

SUMMARY OF THE INVENTION

In brief, the present invention is directed to a game apparatus and method wherein a player must satisfactorily comply with instructions that solicit a rhyming response. In the preferred embodiment shown in the drawings, the invention is embodied as a board game. It should be understood, however, that for use as an educational tool, for example, where every player is a winner in terms of each player increasing his or her creative thinking and creative writing skills, and increased memory capability, all that is required is a means for directing each player to a word selected at random, such as a plurality of playing cards, and an instruction to use that word in a rhyming story, as will be explained in more detail with reference to the preferred board game.

In the preferred embodiment, the game board includes a starting space, a winning space, and a number of distinguishable spaces therebetween. The spaces are divided into several categories that are distinguishable by different indicia and/or different colors and/or different category names. Each category of space requires a player to comply with a particular instruction. When a player occupies one category of game board space, one or more players must recite a word that rhymes with a word selected at random, e.g., from a playing card; another category of game board space requires a player to create or recite a multi-line rhyme, one line ending with a word selected at random, and the remaining lines ending with a word that rhymes with the word selected at random—the last words of the remaining lines can be chosen by the player from any words, or instructions may require the player to use one or more last words from a list of rhyming words; another category of space on the game board requires a player to create or recite a multi-line greeting card message, wherein the last word of each line rhymes with one of said last words of another line, selected at random; another category of space on the game board requires a player to recite two multi-word lines from a literary or musical work—one line ending in a word that rhymes with an ending word of the other line.

Accordingly, one aspect of the present invention is to provide a game apparatus and method that includes instructions for creating or reciting a rhyme, within a designated period of time.

Another aspect of the present invention is to provide a board game and method of playing a family interactive, educational, challenging game, e.g., a board game, that is entertaining and develops or enhances a person's creativity, poetic or rhyming skill.

Still another aspect of the present invention is to provide a board game and method of playing the board game that include instructions requiring a player to create or recite a rhyme, in story form, within a designated period of time, selected from (a) through (e), as follows: (a) recite a word that rhymes with a word selected at random; (b) create or recite a multi-line rhyme, each line containing a plurality of words, one line ending with a word selected at random, and the remaining lines ending with a word that rhymes with the word selected at random; (c) create or recite a multi-line rhyme, each line containing a plurality of words, a plurality of said lines each ending with a word that rhymes with a word selected at random—the last words of the remaining lines can be chosen by the player from any words, or instructions may require the player to use one or more last words from a list of rhyming words; (d) recite two multi-word lines from a literary or musical work—one line ending in a word that rhymes with an ending word of the other line; and (e) create or recite a multi-line greeting card message, each line containing a plurality of words, one line of said message ending in a word that rhymes with an ending word of another line thereof—preferably, one line ends in a specific word chosen at random.

A further aspect of the present invention is to provide an educational tool capable of increasing the creativity, memory and rhyming or lyrical talents of those who use it, comprising a means for directing a student or player to a word selected at random, such as a plurality of playing cards each having at least one word printed thereon, or a means for projecting one or more words onto a wall or shown on a viewing screen, one by one, or as a plurality of words; and a means for instructing the student, with respect to the random word, such as a series of instructions, e.g., printed on an instruction sheet or projected onto a wall or viewing screen, the specific instruction selected at random, or in accordance with an order predesigned by a teacher or player instructing the student to: (a) recite a word that rhymes with a word selected at random; (b) create or recite a multi-line rhyme, each line containing a plurality of words, one line ending with a word selected at random, and the remaining lines ending with a word that rhymes with the word selected at random; (c) create or recite a multi-line rhyme, each line containing a plurality of words, a plurality of said lines each ending with a word that rhymes with a word selected at random—the last words of the remaining lines can be chosen by the player from any words, or instructions may require the player to use one or more last words from a list of rhyming words; (d) recite two multi-word lines from a literary or musical work—one line ending in a word that rhymes with an ending word of the other line; and (e) create or recite a multi-line greeting card message, each line containing a plurality of words, one line of said message ending in a word that rhymes with an ending word of another line thereof—preferably, one line ends in a specific word chosen at random.

Other variations as well as the above-described and other very entertaining and creativity-enhancing aspects of the game apparatus and method of the present invention will become more apparent from the following detailed description of the preferred embodiment taken in conjunction with the drawings. By game apparatus and method, it is envisioned by those skilled in the art that the game board, playing cards, instructions, player tokens, and timing apparatus, disclosed in more detail hereinafter, could be displayed visually, e.g., on a television screen or other monitor. The game described herein, therefor, could be provided in a VCR version, computer version, and other formats known by those skilled in the art.

BRIEF DESCRIPTION OF THE DRAWINGS

FIG. 2A is a view of an instruction guide that relates the categories of game board spaces to particular instructions;

FIG. 3A is a perspective view of a box containing a deck of playing cards forming a portion of the game apparatus of the present invention;

FIGS. 3B and 3C are front views of examples of two playing cards removed from the deck of playing cards shown in FIG. 3A;

FIG. 4 is a front view of a player token that is moved around the game board from a Start space toward a Winning Challenge space;

FIG. 5 is a perspective view of a die that is rolled by each player to determine how many spaces the player's token is advanced around the game board upon a player successfully complying with instructions on a playing card; and FIG. 6 is a perspective view of an hour glass-type timing apparatus used to limit the time that a player has to comply with playing card instructions.

DETAILED DESCRIPTION OF THE PREFERRED EMBODIMENT

Figure 1:
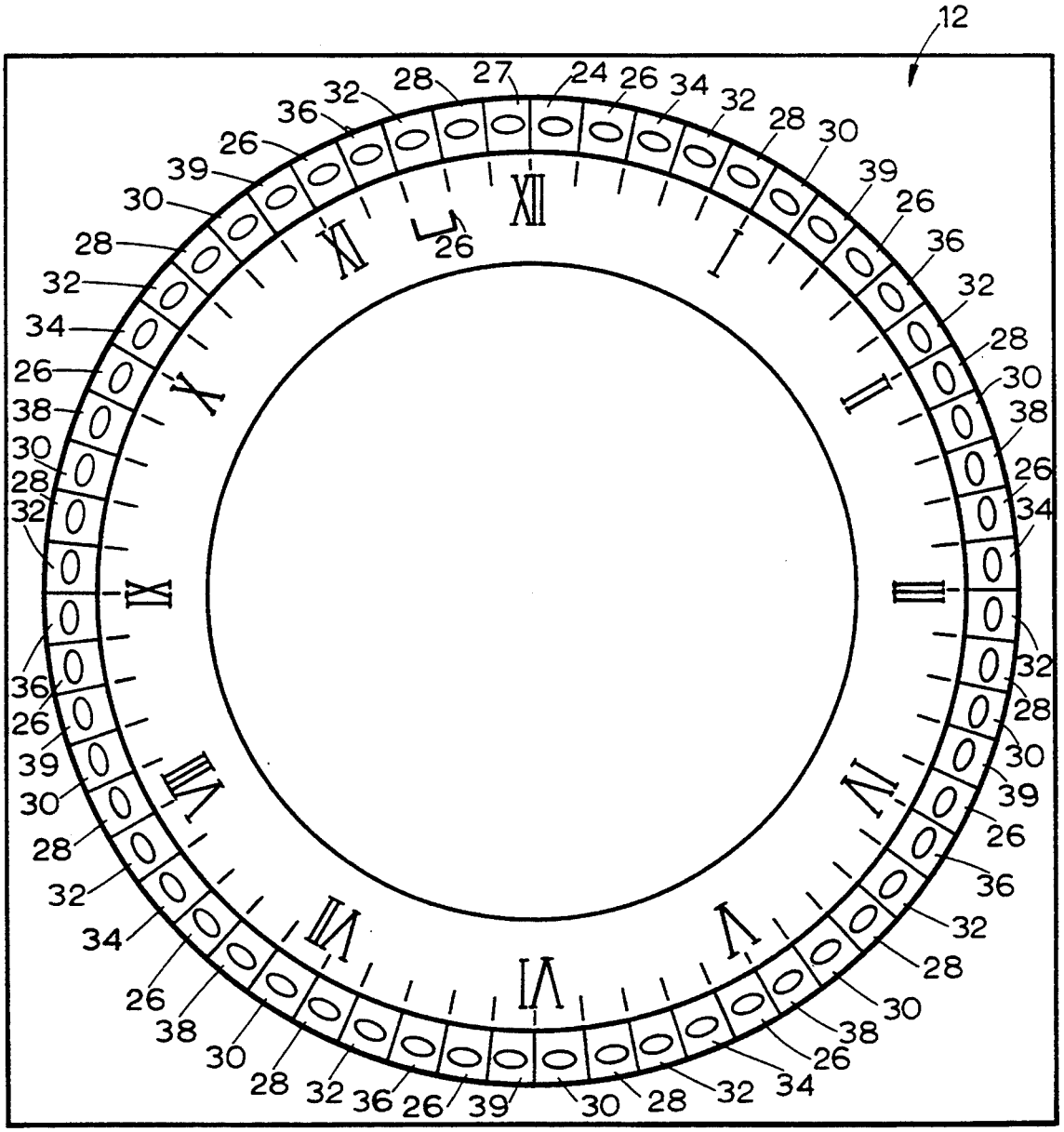
FIG. 1 is a top view of a game board portion of the game apparatus of the present invention.
Figure 2B:
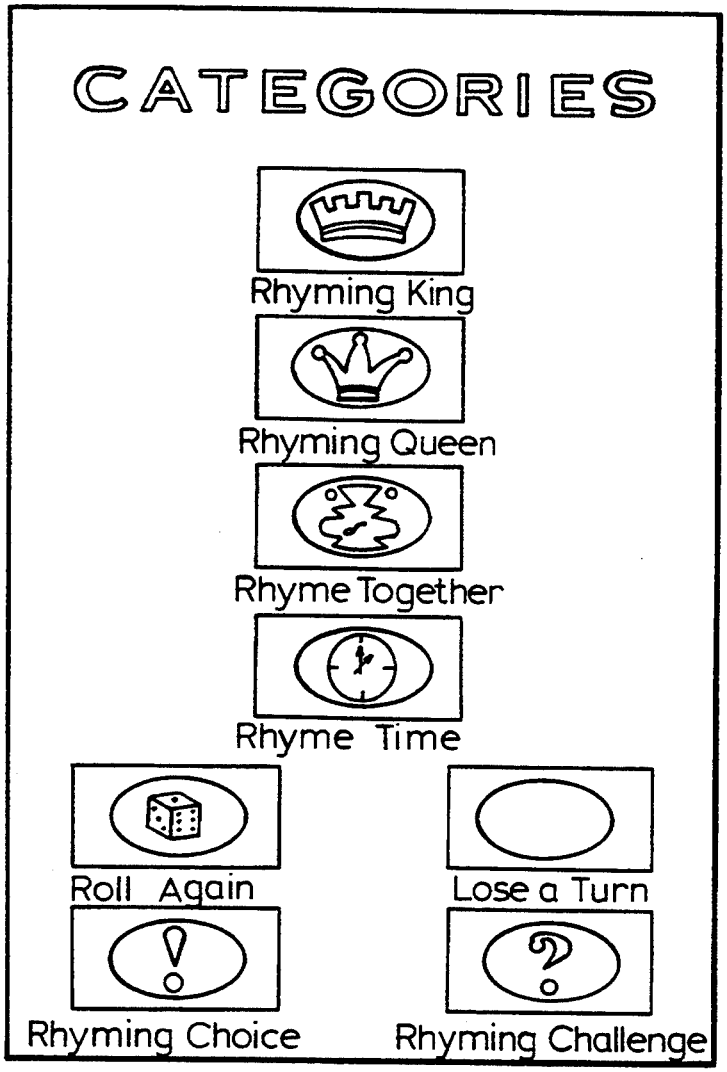
FIG. 2B is a view of a category space guide appearing on the reverse side of the instruction guide.

The present invention is directed to a game apparatus and method that challenges, enhances or develops a player's creativity, vocabulary, memory, improvisational skills, lyrical skills and particularly develops and enhances a player's skill in creating a multi-line story, wherein each line of the story ends in a rhyming word. The general object of the game apparatus and method is to be the first player, or team, to rhyme his way completely around a game board and then land with an exact roll of the die into a space marked WINNING CHALLENGE. The winner is the player, or team, who responds correctly to his opponent's Winning Challenge instructions. The method of playing the game and the rules of play are best described with reference to the drawings that depict the components of the preferred game apparatus of the present invention.

As shown in FIGS. 1–6, the preferred game apparatus includes a game board 12 (FIG. 1); a mini instruction guide 14 (FIG. 2) that is received by each player or team of players—each mini instruction guide being identical and defining a particular instruction for some of the categories of game board spaces, as described in more detail hereinafter; a category space guide 15, appearing on the reverse side of the instruction guide 14; a deck of playing cards 16 (FIG. 3A), containing individual, different playing cards 18 and 19 (FIGS. 3B and 3C) each card 18, 19 containing different words thereon; a plurality of different, distinguishable player tokens, having names that are associated in some way with rhyming, such as the "RHYMING RAPPER" token 20, shown in FIG. 4; a die 21 (FIG. 5); and a timing device, such as the hour glass-type device 22, shown in FIG. 6. This apparatus shown in FIGS. 1–6 comprises a full preferred embodiment of the game apparatus of the present invention containing a number of distinguishable player tokens, such as the token 20 shown in FIG. 4 and, preferably about 20 to 1,000, preferably about 300 playing cards to form the deck of playing cards shown in FIG. 3A.

To start the game, each player, or team of players, rolls the die 21 and the player or team who rolls the highest number, gains control of the board and begins the game with another roll of the die 21. In the preferred embodiment, each new turn will begin with a roll of the die so that a player moves his token the number of spaces corresponding to the number on the die, prior to being required to correctly provide a rhyming response; alternatively, game rules can provide that it is necessary to correctly provide a rhyming response to instructions, e.g., on one of the playing cards 18 or 19 prior to rolling the die and advancing a player's token from a Start space 24, at the top of game board 12, toward the Winning Challenge space 26, located adjacent to a Stop space 27. It should be noted that the Rhyme Time Category of spaces requires no word selected at random, and therefore no playing card is drawn when a Rhyme Time space is landed on. The rules for Rhyme Time spaces will be explained in more detail hereinafter.

Once the game has begun, the player, or team of players, in control of the board remains in control of the board until that controlling player, or team, fails to respond correctly to instructions associated with a category of spaces occupied by that player, or until that player lands on a category of space that requires that player to lose a turn. Every correct response to an instruction associated with a category of space occupied by the controlling player permits that player to again roll the die 21 to determine how many spaces that player's token will advance on the game board 12. In accordance with preferred game rules, if a player loses control of the board, the die passes to the player or team on his left (clockwise), except when the controlling player occupies a Rhyme Together space, explained in more detail hereinafter.

In accordance with the preferred embodiment of the game board 12 shown in FIG. 1, the game board 12 is in the form of a circular clock face having 60 distinguishable, adjacent spaces, each corresponding to one minute of the clock, and the clock face is numbered 1–12 to correspond to each numbered hour that commonly appears on watches and clocks. Each player or team of players is represented by a game token, the game tokens being represented by Rhyming Mice, each game token distinguishable from an opponent's game token, such as token 20, shown in FIG. 4.

The preferred game board 12, shown in FIG. 1, includes six general categories of spaces, each category of space appearing on the board a total of 10 times, accounting for a total of 60 spaces. Each category of space is repeated every six spaces and separated by five spaces representing five other categories. The six different categories of spaces are represented and distinguished from other categories of spaces around the board by each category of space being identifiable by a different color and/or a different symbol or other distinguishing indicia, such as a category name.

The six different categories of spaces, each category, for example, represented by a black ellipse surrounded by a background color distinguishable from a background color of the other five categories of spaces, are as follows: blue spaces 26, called "Rhyming King" and represented by the symbol of a king's crown within the black ellipse; yellow spaces 28, called "Rhyming Queen" and represented by the symbol of a queen's crown within the black ellipse; purple spaces 30, called "Rhyme Together" category and represented by the symbol of two people's faces having open mouths and a musical note therebetween within the black ellipse; turquoise spaces 32, called "Rhyme Time" category and represented by the symbol of a clock within the black ellipse.

The remaining two categories of spaces—ten orange background spaces and ten olive green background spaces—each comprise five spaces each of two different sub-categories. The ten orange spaces include five orange spaces 34, called "Rhyming Choice" and represented by the symbol of an exclamation point within the black ellipse, and five orange spaces 36, called "Rhyming Challenge" and represented by the symbol of a question mark within the black ellipse. The ten olive green spaces also include five spaces each of two different sub-categories having olive green backgrounds—five olive green spaces 38, called "Roll Again" and represented by the symbol of a die within the black ellipse; and five olive green spaces 39, called "Lose A Turn" and represented by the symbol of a solid black ellipse having no indicia therein.

Only the blue Rhyming King category spaces, the yellow Rhyming Queen category spaces and the purple Rhyme Together category spaces require a playing card to start play. The instructions for the olive green category (or sub-categories) of spaces, including both the Roll Again sub-category and the Lose A Turn sub-category, are self-evident. If a player lands with a player token 24 on an orange Rhyming Choice space 34, that player may choose an instruction from any of the Rhyming King, Rhyming Queen or Rhyme Time categories of spaces, as set forth on the mini instruction guide. If a player lands on an orange Rhyming Challenge space 36, that player's opponents choose instructions from the Rhyming King, Rhyming Queen, or Rhyme Time instructions appearing on the category card. The particular instructions associated with the Rhyming King, Rhyming Queen, and Rhyme Time spaces 26, 28 and 32, respectively, appear on the mini instruction guide 14, shown in FIG. 2, and are set forth in more detail in the following detailed explanation:

RHYMING KING

"So you want to be a Rhyming King? A four line rhyme you must say with a zing. It really isn't a difficult thing, So give it a try and make it ring a ding ding!"

To start, the board-controlling player takes a playing card, e.g., 18, 19 from the front of the deck of cards 16 and reads aloud to his opponents the single word from the Rhyming King category. After the word has been read aloud, the controlling player's opponents will activate the timing device 22. The controlling player has a designated period of time, e.g., 30–45 seconds to create a four line "story" rhyme using the word from the playing card as the word selected at random. The designated time period can vary with the degree of skill, age, and the like, of the players. The players can modify the designated time limit, as agreed to by all or a majority of players, as play proceeds. The playing card word must appear as a last word of one line in the four line rhyme, with last words of the other three lines rhyming with the randomly selected playing card word.

In accordance with a preferred embodiment of the game method of the present invention, it is important that the controlling player's four line rhyme develops into a "story", which makes sense, for the controlling player to continue play. Whether or not the four line rhyme develops into a "story" that makes sense is subjectively determined by a vote by the controlling player's opponents.

EXAMPLE: A four line rhyme using a Rhyming King word from a playing card, e.g., "HAM":

"HAVE YOU SEEN MY BROTHER SAM?
LATELY HE'S BEEN SUCH A HAM. HE WAS
DESPERATE FOR MONEY AND IN A JAM, SO
HE WENT ON A COMEDY SHOW DRESSED AS
A MADAME".

The Rhyming King word "HAM" must be at the end of any one of the controlling player's four rhyming lines. Three more words, of the controlling player's choice, must rhyme with "HAM" and be at the end of each of the other three lines of the "story" rhyme created.

In accordance with the preferred playing rules, a proper noun, such as "SAM" in the above example, can only be used once in any four line rhyme.

There is no limit to the length or number of the lines in the controlling player's rhyme. The more detail and the more creative that a controlling player can be in creating a multi-line rhyming "story", the more fun and entertaining the game will be.

EXAMPLE: The following simple rhyme is acceptable:

"I LIKE HAM ON TOAST WITH JAM WHEN I'M WITH SAM; AT GRAND LAKE DAM."

An example of a more creative, more fun rhyme is as follows:

ONE DAY I WENT TO SEE MY SHRINK 'CAUSE I WAS OBSESSED WITH THE COLOR PINK I SAT ON THE SOFA AND STARTED TO THINK FOR THE COST OF THIS SESSION I COULD BUY A PINK MINK

VOTING RULES

A controlling player's opponents will decide if the four line rhyme comprises a "story" and makes sense by a vote of a "thumbs up" or a "thumbs down". The controlling player is not allowed to vote on his own rhyme.

Majority vote will rule. If the vote is in favor of the controlling player's rhyme, the controlling player will continue his turn with another roll of the die. If the vote is not in favor, the controlling player loses control of the board and passes the die to the player or team on his left.

If the vote is a tie, the tie breaker will be made with a roll of the die. A roll of an even number, allows the controlling player to remain in control of the board. A roll of an odd number causes the controlling player to lose control of the board.

TEAM RULES

Team players will alternate lines when creating a team rhyme. For example, when two players are on a team, a first player will create the first and third lines and a second player will create the second and fourth lines. Team players must remember to create lines that work well together so that their combined four lines comprise a "story" rhyme.

In accordance with preferred game rules, if one team player becomes stuck, a teammate may help by giving the stuck player a rhyming word, but the helping teammate cannot complete the line that includes the suggested rhyming word.

Once a playing card, e.g., 18, 19 has been used, after each play, and in each category where a playing card is needed, the playing card should be returned to the back of the card deck 16.

RHYMING QUEEN

"Some say it's harder with Rhyming Queen, So be prepared, be ready and keen. Don't worry about stumbling or making a scene, Because after a while, it will just be routine!"

The Rhyming Queen category is similar to Rhyming King. To start, the controlling player removes a playing card from the front of the deck of cards 16. The controlling player then reads aloud from the Rhyming Queen category the word in BOLD as well as the five additional words and/or phrases listed under the Rhyming Queen category. The controlling player's opponents will then actuate the timing device 22 for a designated period of time, e.g., 30–45 seconds. The controlling player must then use the BOLD word in at least one line of his four line "story" rhyme and must also use three of the five remaining words and/or phrases as a last word in three additional lines of the created, four line "story" rhyme.

EXAMPLE: A four line "story" rhyme using the following Rhyming Queen words from a playing card:

"HEARTBURN" concern, live and learn, intern, toss and turn, tax return.

EVERY NIGHT I HAVE HEARTBURN SOMEDAY YOU'D THINK I'D LIVE AND LEARN INSTEAD I LAY AND TOSS AND TURN, THINKING ABOUT MY LATE TAX RETURN The first word from the card, HEARTBURN, can appear at the end of any one of the four lines. The controlling player may choose any three of the five remaining words and/or phrases on the playing card to complete his "story" rhyme. The chosen words must be at the end of three additional lines of the "story" rhyme.

Voting and team rules are the same as for the Rhyming King category of spaces.

RHYME TOGETHER

"Let's get started, let's have some fun. Yell out a word one-by-one. And when it's over, finished and done. Who'll win this round? Mother, Daughter or Son?

This is an "All Play" category. The timing device 22 is not needed. A round of Rhyme Together will start for all players when the controlling player removes a playing card from the front of the deck of cards 16 and reads aloud (spelling if necessary) the single, randomly selected word from the playing card that is associated with the Rhyme Together category.

Once the Rhyme Together randomly selected word has been read aloud, the player or team on the controlling player's left must quickly call out a word that rhymes with the randomly selected word, and so on, continuously in order, through each player and team of players (one word per player or team on each turn). Each player takes as many turns as possible by continuously calling out new rhyming words in this quick, clockwise manner.

EXAMPLE: A Rhyme Together word may be "Dude". The round starts with each player or team calling out words, one-by-one, such as:

RUDE, PRUDE, CRUDE, NUDE, SUED, LONGITUDE, PROTRUDE, EXCLUDE, INCLUDE, LEWD, SPEWED . . .

In a case where two or more words are identically pronounced but are spelled differently, e.g., like Crude and Crewed, only one of the words may be used. A different player cannot thereafter use an identically pronounced word while explaining another spelling. In addition, only one proper noun may be given per player or team during a round of Rhyme Together.

When it is a player's turn and that player does not call out a new rhyming word quickly, his opponents will start counting aloud, One-One Thousand, Two-One Thousand, Three-One Thousand, Four-One Thousand, Five-One Thousand—YOU'RE OUT! The player has until his opponents say, "YOU'RE OUT", to produce an acceptable rhyming word.

Once a player is out of the round, the next player or team must continue by quickly calling out a new rhyming word. Even though a player is "Out" he still should listen and help judge the remaining players.

If a player calls out an unacceptable word, it is the responsibility of his opponents to protest by pointing out one of the reasons detailed hereinafter. After a protest is decided, if the player's opponents all agree that the protest is valid, the player is automatically out of the round.

"Unacceptable" words are words that:

(a) Have already been said, or are (b) Not in the dictionary (Slang or foreign words should be considered for "House Rules"), or (c) Do not rhyme, or are the (d) Second time a player or team of players, has used a proper noun.

If a player, or team of players, calls out an "unacceptable" rhyming word and one of his opponents does not protest the word before the next player or team calls out another rhyming word, the player is still in this round of play and does not have to produce an "acceptable" word until it is his turn again.

The last player or team who calls out an "acceptable" rhyming word without a protest, gains control of the board. The game will continue from the winner of this category in a clockwise direction even though some players' turns may have been skipped.

If team players, during their turn, call out two different "acceptable" rhyming words at the same time, the following player, or team, may use one of those two words for his turn. Team players should consider appointing a spokesperson. Team players can talk among themselves during this round of play.

RHYME TIME

"Marcel Marceau was the Master of mime. Batman was the Master of ridding crime. Now it's time to remember an old rhyme; So you can be the Master of Rhyme Time!"

This category requires a player to remember and recite lines of rhyme from today and the past. The object is for a player or a team to recite two rhyming lines from two different types of literary or musical works. The following examples of literary and musical works may be provided to the players, for example, on the instruction guide—to help the players remember where rhymes are found in literary and musical works.

| | | |
|---|---|---|
| Nursery Rhymes | Music | Poetry |
| Advertising Jingles | Books | Adages |
| TV Theme Songs | Movies | Musicals |
| Campaign Slogans | Plays | School Songs |
| Common Sayings | Quotes | |

Once a player lands on this category, his opponents will immediately actuate the timing device 22 to allow a period of time of, for example, 30–45 seconds, for an acceptable response.

EXAMPLE: A player, in 30–45 seconds or less, must recite two rhyming lines, using two different ending, rhyming words of his choice, from two different types of works, such as, from a Nursery Rhyme and a Common Saying:

"IF YOU STEP ON A CRACK, YOU'LL BREAK YOUR MOTHER'S BACK."

"HICKORY DICKORY DOCK, THE MOUSE RAN UP THE CLOCK,"

EXAMPLE: In the case of two team players, both rhymes must be completed in 30–45 seconds or less. If one player chooses to rhyme from a Song, the other player must rhyme from another work, such as a Campaign Slogan:

"MY COUNTRY, 'TIS OF THEE, SWEET LAND OF LIBERTY,"

"ALL THE WAY WITH LBJ!"

A player is only required to recite two rhyming lines from two different literary or musical works of his choice. However, to get to the point of reciting two rhyming lines, the player is permitted to recite or sing aloud several other lines, so long as the player completes two rhyming lines within the designated period of time, e.g., 30–45 seconds.

Once a player recites two rhyming lines from a particular work or title, no remaining rhyming lines from that title may be repeated during the game by that player or any other player. If a player does repeat a rhyme, he loses his turn and passes the die to the next player on his left.

If an opponent wants to protest, for example, because the controlling player said, Hickory Dickory "Crock" instead of "Dock", the opponent must give a valid reason and, after the discussion, the protest will be put to a vote, following the same voting rules as for the Rhyming King category of spaces.

RHYMING CHOICE!

RHYMING CHALLENGE?

"Get the gist? Well raise your voice, Because this category is Rhyming Choice. No wait! Sit back and cringe, It's not your choice, it's Rhyming Challenge."

When the controlling player's token, e.g., 24 lands on a Rhyming Choice category space 34, the player may choose a rhyming category from the Rhyming King, Rhyming Queen, or Rhyme Time categories of instructions.

When the controlling player lands on a Rhyming Challenge category space 36, the player's opponents will choose a rhyming category for the controlling player from the same list of instruction categories—Rhyming King, Rhyming Queen and Rhyme Time. Once a category is chosen, the rules of that category apply.

ROLL AGAIN

LOSE A TURN

"At times you'll feel your temper burn, Especially when you land on Lose A Turn. But stay calm, all you ladies and men, Because your next roll could be Roll Again!"

When a player's token, e.g., 24, lands on a Roll Again space 38, the die 21 is rolled again and the player's token is moved forward (clockwise) the number of spaces shown on the die.

When the controlling player's game token, e.g., 24, lands on a Lose A Turn space 39, the die passes to the player or team on the player's left.

WINNING CHALLENGE/FINISHING THE GAME

"You've come so far, and you're now so near, To proving you're a bit like Shakespeare. A poet, a songster and a sonneteer. Just get it right, and all will cheer!"

Winning Challenge is Rhyming King with a twist

An exact roll of the die is required to enter the Winning Challenge space 26. When a player proceeds completely around the board to the STOP space 27, the player must roll a one to move into the Winning Challenge space 26. If the player rolls any number but a one, he has overshot and must stay in the STOP space 27 and pass the die to the player on his left. On the next turn, that player in the STOP space 27 can try again to roll a one to proceed into the Winning Challenge space 26.

Once a player enters the Winning Challenge space 26, his opponents will choose a "greeting card" topic.

A greeting card topic can be chosen from the following topics, or the player can create his own topic:

| | | |
|---|---|---|
| Holidays | Birthdays | Valentine |
| Graduation | Anniversary | Get Well |

Next, the player in the Winning Challenge space 26 will remove a playing card, e.g., 18, 19 from the deck of cards 16 and use the Rhyming King word as his rhyming word. The object of Winning Challenge is for the player to create a four line "story" rhyme that is consistent with the "greeting card" topic his opponents have chosen. The controlling player's opponents will then activate the timing device 22 for a designated period of time, e.g., 30–45 seconds.

The rules for the Rhyming King category apply.

EXAMPLE: The Rhyming King word is "PLAY" and the controlling player's opponents have chosen the topic "GET WELL":

"MY VERY BEST WISHES I'D LIKE TO CONVEY, WHILE FLAT ON YOUR BACK IN THE HOSPITAL YOU LAY. I TOLD YOU FOOTBALL WAS A STUPID GAME TO PLAY. BUT I'LL MISS YOU ANYWAY, WHILE YOU'RE AWAY!"

If the player's opponents vote "thumbs down", or the controlling player does not complete his rhyme within the designated period of time, e.g., in 30–45 seconds, the player will pass the die to the player on his left and wait until it is his turn again to attempt another four line greeting card rhyme. This process will continue until one player or team completes the Winning Challenge four line greeting card rhyme to the satisfaction of his opponents. A new "greeting card" topic, or the same greeting card topic, may be chosen by the player's opponents each time a player in the Winning Challenge space 26 attempts another four line greeting card rhyme.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A method of playing a board game including a game board having a plurality of distinguishable spaces including a starting space, a winning space, and a plurality of spaces therebetween, wherein advancement of a player from said starting space to said winning space is dependent upon a player successfully complying with instructions for creating or reciting a rhyme within a designated period of time, said instructions selected from the group consisting of:

(a) creating or reciting a multi-line rhyme, each line containing a plurality of words, one line ending with a word selected at random, and the remaining lines ending with a word that rhymes with the word selected at random;

(b) creating or reciting a multi-line rhyme, each line containing a plurality of words, a plurality of said lines ending with a word that rhymes with a word selected at random;

(c) reciting two multi-word lines from a literary or musical work—one line ending in a word that rhymes with an ending word of the other line; and (d) choosing a greeting card topic such as a holiday, birthday, graduation, etc., creating or reciting a multi-line greeting card message relating to the chosen greeting card topic, each line containing a plurality of words, one line ending with a word selected at random, and the remaining lines ending with a word that rhymes with the word selected at random.

2. A method as defined in claim 1, wherein the board spaces comprise a plurality of separate types of category spaces, each type of category space appearing a number of times on the board, and wherein the word selected at random appears on playing cards, each playing card including at least one word for a plurality of types of category space, and wherein the random word selected from the playing card is determined by the type of category space occupied by a player token.

3. A method as defined in claim 2, wherein each playing card has a plurality of different instructions, each instruction corresponding to a different type of category space, one of said instructions requiring a player to create a four line rhyme, each line containing a plurality of words, the four lines taken together forming a sensible story, wherein one line ends with the random word appearing on the playing card and corresponding to said type of category space occupied by the player's token, and the remaining three lines ending with a word that rhymes with said random word.

4. A method as defined in claim 2, wherein each playing card has a plurality different instructions, said plurality of different instructions appearing on each card, each different instruction corresponding to a particular type of category space, one of said instructions listing at least four different rhyming words and requiring a player to create or recite a four line rhyme, each line containing a plurality of words, said lines comprising a story, the last word of each line ending in a different one of the listed words.

5. A method as defined in claim 4, wherein said one instructions provide more than four rhyming words in the list, so that not all listed words are line-ending words of the four line rhyme, allowing the player to select less than all of the listed words to include in the four line rhyme.

6. A method as defined in claim 2, wherein each playing card includes a plurality of different instructions, each of said plurality of different instructions appearing on each card, each of said different instructions corresponding to a particular type of category space, one of said instructions listing a word and requiring a player to create or recite a four line rhyme, each line containing a plurality of words, one of said lines ending in the listed word and the remaining three lines ending in a word that rhymes with the listed word.

7. A method as defined in claim 2, wherein the degree of advancement of a player toward the winning space is determined by the player rolling a die, and wherein the category spaces include a space that, if landed on, the player rolls the die again, and a space that, if landed on, the player loses a turn.

8. A method as defined in claim 1, wherein the player advances by rolling a die and advancing a number of spaces corresponding to a number appearing on an upwardly facing surface of the die, either before or after complying with said instructions.

9. A method as defined in claim 8, wherein the player advances the number of spaces that appears on the upwardly facing surface of the die prior to complying with said instructions, and if the player does not then comply with said instructions, the player does not roll the die again, but it is another player's turn.

10. The method as defined in claim 1, wherein one of the instructions permits the player to select his own instructions (b), (c) or (d).

11. The method as defined in claim 1, wherein one of the instructions permits the player's opponents to select the player's instructions (b), (c) or (d).

12. A method of playing a board game including a game board having a plurality of distinguishable spaces including a starting space, a winning space, and a plurality of spaces therebetween, wherein advancement of a player from said starting space to said winning space is dependent upon a player successfully complying with instructions for creating or reciting a rhyme within a designated period of time, wherein said instructions require a player, within a designated period of time, to recite a word that rhymes with a random word, and then, in turn, every other player must then recite a word that rhymes with said random word, without repeating a word recited by any other player, if a player fails to recite a word or if a player recites an unacceptable word that player is out of the round, until only one player remains in the round and recites an acceptable rhyming word, said one player advancing toward the winning space.

13. A method of playing an educational, creativity-enhancing game including means for directing a player to a word selected at random, and instruction means for providing the player with instructions for creating or reciting a rhyme containing the word selected at random, within a designated period of time, said instruction means including instructions selected from the group consisting of:

(a) reciting a word that rhymes with a word selected at random;

(b) creating or reciting a multi-line rhyme, each line containing a plurality of words, one line ending with a word selected at random, and the remaining lines ending with a word that rhymes with the word selected at random; and (c) creating or reciting a multi-line rhyme, each line containing a plurality of words, a plurality of said lines ending with a word that rhymes with a word selected at random.

14. The method of claim 13, wherein the means for selecting a word at random comprises a plurality of cards, each having printed thereon a different word.

15. The method of claim 14, wherein the instruction means for providing the player with instructions comprises an instruction guide listing the instructions (a), (b) and (c).

16. A method of playing a board game with a plurality of players comprising:

(a) providing: a game board having a starting space, a winning space and plurality of distinguishable spaces therebetween, creating a continuous path from said starting space to said winning space; a plurality of playing cards having at least one word on each card to be rhymed by a player in the form of a phrase or sentence ending with a word rhyming with a word appearing on said playing card; a plurality of player tokens; chance means manipulatable by a player for determining how many spaces toward the winning space that a player will advance upon providing an acceptable rhyme in response to instructions on one of said playing cards; and a timing means for limiting a period of time within which each player must create said rhyme in accordance with instructions associated with said playing card; and (b) allowing said players, in turn, to create or recite said phrase or sentence ending in a rhyming word, said rhyming word rhyming with a word shown on a playing card selected in accordance with the board space occupied by said player's token;

wherein upon a player creating a rhyme containing said rhyming word in the form of a phrase, or one or more sentences, in accordance with instructions associated with said particular playing card, and allowing the opposing players to view or hear said rhyme to determine subjectively whether or not the rhyme has complied with the instructions associated with the player's playing card, the player advances toward the winning space if the opposing players determine that the rhyme has acceptably complied with the playing card instructions associated with the board space occupied by said player.

17. A method as defined in claim 16, wherein the board spaces comprise a plurality of separate types of category spaces, each type of category space appearing a number of times on the board, each type of category space requiring a player to comply with a different instruction, each different instruction requiring a player to recite one or more phrases or sentences containing a last word that rhymes with a word appearing on said playing card, each playing card including at least one word for each of said types of category spaces, and wherein the word selected from the playing card is determined by the type of category space occupied by a player token.

18. A method as defined in claim 17, wherein the degree of advancement of a player toward the winning space is determined by the player rolling a die, and wherein the category spaces include a space that, if landed on, the player rolls the die again, and a space that, if landed on, the player loses a turn.

19. A method as defined in claim 17, wherein playing card instructions corresponding to one type of category space requires a player, within a designated period of time, to recite a word that rhymes with the random word on the playing card that corresponds to said category type, and then, in turn, every other player must then recite a word that rhymes with said random word, without repeating a word recited by any other player, until only one player succeeds, said one succeeding player advancing toward the winning space.

20. A method as defined in claim 17, wherein each playing card has a plurality of different instructions, each instruction corresponding to a different type of category space, one of said instructions requiring a player to create a four line rhyme, each line containing a plurality of words, the four lines taken together forming a sensible story, wherein one line ends with the random word appearing on the playing card and corresponding to said type of category space occupied by the player's token, and the remaining three lines ending with a word that rhymes with said random word.

21. A method as defined in claim 17, wherein each playing card has a plurality of different instructions, said plurality of different instructions appearing on each card, each different instruction corresponding to a particular type of category space, one of said instructions listing at least four different rhyming words and requiring a player to create or recite a four line rhyme, each line containing a plurality of words, said lines comprising a story, the last word of each line ending in a different one of the listed words.

22. A method as defined in claim 21, wherein said one instruction provides more than four rhyming words in the list, so that not all listed words are line-ending words of the four line rhyme, allowing the player to select less than all of the listed words to include in the four line rhyme.

23. A method as defined in claim 17, wherein each playing card includes a plurality of different instructions, each of said plurality of different instructions appearing on each card, each of said different instructions corresponding to a particular type of category space, one of said instructions listing a word and requiring a player to create or recite a four line rhyme, each line containing a plurality of words, one of said lines ending in the listed word and the remaining three lines ending in a word that rhymes with the listed word.

24. A method as defined in claim 16, wherein the player advances by rolling a die and advancing a number of spaces corresponding to a number appearing on an upwardly facing surface of the die, either before or after complying with said instructions.

25. A method as defined in claim 24, wherein the player advances the number of spaces that appears on the upwardly facing surface of the die prior to complying with said instructions, and if the player does not then comply with said instructions, the player does not roll the die again, but it is another player's turn.

26. The method as defined in claim 16, wherein one of the instructions premits the player to select his own insutructions selected from (1), (2), (3), or (4) as follows:

(1) creating or reciting a multi-line rhyme, each line containing a plurality of words, one line ending with a word selected with a word that rhymes with the word selected at random;

(2) creating or reciting a multi-line rhyme, each line containing a plurality of words, a plurality of said lines ending with a word that rhymes with a word selected at random;

(3) reciting two multi-word lines from a literary or musical work—one line ending in a word that rhymes with an ending word of the other line; and (4) choosing a greeting card topic such as a holiday, birthday, graduation, etc., creating or reciting a multi-line greeting card message relating to the chosen greeting card topic, each line containing a plurality of words, one line ending with a word selected at random, and the remaining lines ending with a word that rhymes with the word selected at random.

27. The method as defined in claim 16, wherein one of the instructions permits the player's opponents to select the player's instructions from (1), (2), (3), or (4) as follows:

(1) creating or reciting a multi-line rhyme, each line containing a plurality of words, one line ending with a word selected at random, and the the remaining lines ending with a word that rhymes with the word selected at random;

(2) creating or reciting a multi-line rhyme, each line containing a plurality of words, a plurality of said lines ending with a word that rhymes with a word selected at random;

(3) reciting two multi-word lines from a literary or musical work—one line ending in a word that rhymes with an ending word of the other line; and (4) choosing a greeting card topic such as a holiday, birthday, graduation, etc., creating or reciting a multi-line greeting card message relating to the chosen greeting card topic, each line containing a plurality of words, one line ending with a word selected at random, and the remaining lines ending with a word that rhymes with the word selected at random.

28. A method of playing an educational, creativity-enhancing game including means for directing a player to a word selected at random, and instruction means for providing the player with instructions for creating or reciting a rhyme containing the word selected at random, within a designated period of time, said instruction means including instructions selected from the group consisting of:

(a) creating or reciting a multi-line rhyme, each line containing a plurality of words, one line ending with a word selected at random, and the remaining lines ending with a word that rhymes with the word selected at random; and (b) creating or reciting a multi-line rhyme, each line containing a plurality of words, a plurality of said lines ending with a word that rhymes with a word selected at random.

29. The method as defined in claim 28, wherein said instruction means includes an instruction selected from the group consisting of:

(c) reciting two multi-word lines from a literary or musical work—one line ending in a word that rhymes with an ending word of the other line; and (d) choosing a greeting card topic such as a holiday, birthday, graduation, etc., creating or reciting a multi-line greeting card message relating to the chosen greeting card topic, each line containing a plurality of words, one line ending with a word selected at random, and the remaining lines ending with a word that rhymes with the word selected at random.

30. The method as defined in claim 28, wherein said instruction means includes an instruction requiring a player, within a designated period of time, to recite a word that rhymes with a random word, and then, in turn, every other player must then recite a word that rhymes with said random word, without repeating a word recited by any other player, until only one player recites an acceptable rhyming word.

* * * * *

UNITED STATES PATENT AND TRADEMARK OFFICE

CERTIFICATE OF CORRECTION

PATENT NO. : 5,441,277

DATED : August 15, 1995

INVENTOR : BRAD E. LENHART, ET AL.

It is certified that error appears in the above-identified patent and that said Letters Patent is hereby corrected as shown below:

Column 7, line 9, "SAM;" should be -- SAM, --.

Column 15, line 40, "premits" should be -- permits --.

Column 15, line 44, after "selected" insert -- at random, and the remaining lines ending --.

Signed and Sealed this

Tenth Day of June, 1997

*Attest:*

*Attesting Officer*

BRUCE LEHMAN

*Commissioner of Patents and Trademarks*